US008388830B2

(12) United States Patent
Sohn et al.

(10) Patent No.: US 8,388,830 B2
(45) Date of Patent: Mar. 5, 2013

(54) PROCESS FOR UPGRADING SWEETENED OR OXYGEN-CONTAMINATED KEROSENE OR JET FUEL, TO MINIMIZE OR ELIMINATE ITS TENDENCY TO POLYMERIZE OR FOUL WHEN HEATED

(75) Inventors: Stephen W. Sohn, Arlington Heights, IL (US); Steven P. Lankton, Wheeling, IL (US); Joao Jorge da Silva Ferreira Alves, Arlington Heights, IL (US)

(73) Assignee: UOP LLC, Des Plaines, IL (US)

( * ) Notice: Subject to any disclaimer, the term of this patent is extended or adjusted under 35 U.S.C. 154(b) by 87 days.

(21) Appl. No.: 13/154,572

(22) Filed: Jun. 7, 2011

(65) Prior Publication Data

US 2011/0319698 A1 Dec. 29, 2011

Related U.S. Application Data

(60) Provisional application No. 61/358,427, filed on Jun. 25, 2010.

(51) Int. Cl.
*C10G 45/00* (2006.01)
*C07C 7/00* (2006.01)

(52) U.S. Cl. ..... 208/264; 208/255; 585/841; 585/867

(58) Field of Classification Search ..... 208/255, 208/264; 585/841, 867
See application file for complete search history.

(56) References Cited

U.S. PATENT DOCUMENTS

| | | | | |
|---|---|---|---|---|
| 2,766,179 | A * | 10/1956 | Fenske et al. | 208/264 |
| 4,017,276 | A | 4/1977 | Bloem | |
| 5,112,357 | A | 5/1992 | Bjerklund et al. | |
| 6,315,815 | B1 | 11/2001 | Spadaccini | |
| 6,709,492 | B1 | 3/2004 | Spadaccini | |
| 7,153,343 | B2 | 12/2006 | Burlatsky | |
| 7,435,283 | B2 | 10/2008 | Tillman | |
| 7,459,081 | B2 | 12/2008 | Koenig | |
| 2009/0020013 | A1 | 1/2009 | Sloan | |
| 2009/0188839 | A1 | 7/2009 | Schlueter et al. | |

FOREIGN PATENT DOCUMENTS

| | | | |
|---|---|---|---|
| JP | 62151491 | A | 7/1987 |

OTHER PUBLICATIONS

Zhou, Gatalylio Hydrogenation Process Simulating Evaluation of Removing Oxygen Dissolved in Kerosene, Modern Chemical Industry, Jul. 2006, v 26, n. 7, p. 55-57.

Darrah, Jet Fuel Deoxygenation, Technical Report AFWAL-TR-Air ForceWright Aeronautical Laboratories (US), v 88, n. 2031, Oct. 1938.

Ervin, Effects of Reduced Dissolved Oxygen Concentration on Jet Fuel Deposit Formation, Symposium on Coke Formation and Mitigation presented before the Division of Petroleum Chemistry, Inc. 210th National Mtg., American Chemical Society, Chicago, IL Aug. 20-25, 1995, Preprints v 40, n. 4, p. 660-665.

Furimsky, Catalylic Removal of Sulfur, Nitrogen, and Oxygen from Heavy Gas Oil, AlChE Journal, v 25, n 2, p. 306-311, Mar. 1979.

* cited by examiner

*Primary Examiner* — Randy Boyer
(74) *Attorney, Agent, or Firm* — Arthur E Gooding

(57) ABSTRACT

A process is presented for the removal of oxygen from a hydrocarbon stream. The oxygen can react and cause polymerization of the hydrocarbons when the hydrocarbon stream is heated. Controlling the removal of the oxygen from the hydrocarbon stream produces a hydrocarbon stream that is substantially free of oxygen and has a reduced activity for generating undesired compounds.

15 Claims, 1 Drawing Sheet

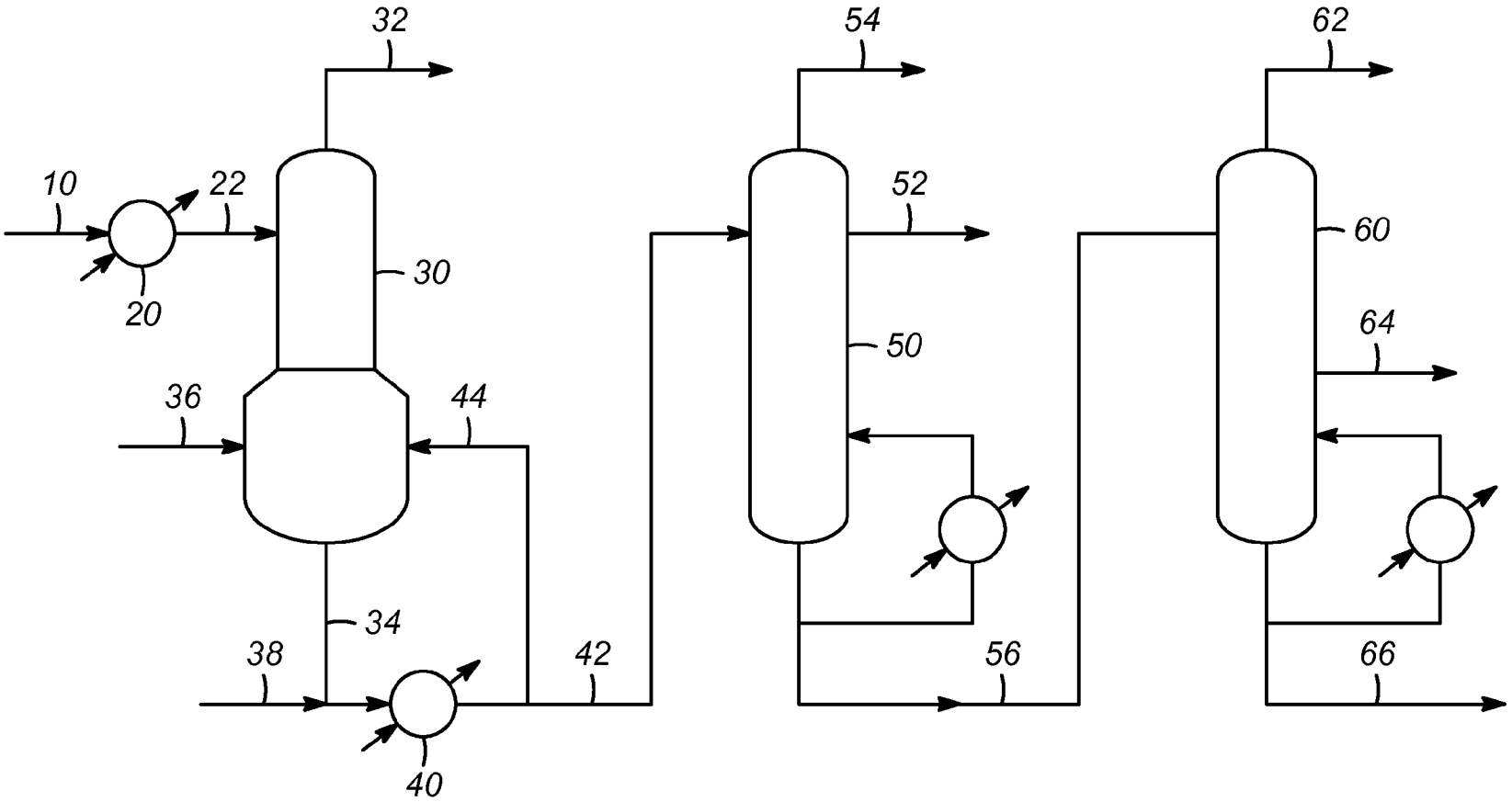
10
20
22
32
30
36
44
34
38
40
42
54
52
50
56
62
60
64
66

PROCESS FOR UPGRADING SWEETENED OR OXYGEN-CONTAMINATED KEROSENE OR JET FUEL, TO MINIMIZE OR ELIMINATE ITS TENDENCY TO POLYMERIZE OR FOUL WHEN HEATED

CROSS-REFERENCE TO RELATED APPLICATION

This application claims the benefit of U.S. Provisional Application No. 61/358,427 filed Jun. 25, 2010.

FIELD OF THE INVENTION

The present invention relates to the processes of treating fluids. In particular, the invention relates to the treatment of fuels to remove oxygen contaminated materials.

BACKGROUND OF THE INVENTION

Chemicals, and in particular, hydrocarbon mixtures, that are stored for extended periods of time can become contaminated, or in the presence of contaminants accumulate deposits that are detrimental to the equipment through which the chemicals flow. In particular, fuels can often sit in storage containment units, such as storage tanks or shipping vessels. The fuels are usually hydrocarbon mixtures, and contaminants in the fuels can bring about some polymerization or the creation of gums. These molecules can impair the performance of engines which run on the fuel. The gums or other materials can create deposits that impair flow, or heat transfer characteristics in an engine, which in turn can impair engine performance.

An important contaminant is oxygen. Oxygen contaminants lead to undesirable chemical products by a variety of reaction processes. These reactions include autocatalytic mechanisms that include free radical chain reactions. Olefins and other reactive chemical compounds, in the presence of oxygenate contaminants can lead to polymerization products and potentially also to deposits on metal surfaces. Fouling causes increased maintenance of equipment, and reduces operation times, and a loss of production.

The removal of oxygen and residual oxygen contaminants from hydrocarbon feedstocks can reduce the down times and protect equipment from excessive fouling due to deposits created from reactions by the presence of oxygen in the hydrocarbon feedstocks.

SUMMARY OF THE INVENTION

Oxygen contamination in a jet fuel, or in kerosene is an important problem. The present invention provides a method of removing residual dissolved oxygen to prevent the problems associated with the presence of oxygen in either a jet fuel or kerosene.

The process is for stripping oxygen from a hydrocarbon feedstream, and in particular a kerosene feedstock. The process includes passing the hydrocarbon feedstream through a preheater, where the feedstream is heated to a temperature of up to 140° C. The preheated feedstream is passed to an oxygen stripper, where a stripping gas, having substantially zero oxygen, is passed to the stripper to remove the dissolved oxygen from the hydrocarbon feedstream. The dissolved oxygen is passed out of the stripper in the overhead vapor stream comprising the stripping gas. The stripped hydrocarbon stream is passed out of the bottom of the stripper, and is heated to remove dissolved stripping gas. The removed stripping gas is vented or passed to other units for possible usage.

In one embodiment, a portion of the heated stripped hydrocarbon stream is cycled back to the bottom of the stripper to heat the bottom section of the oxygen stripper.

Additional objects, embodiments and details of this invention can be obtained from the following drawing and detailed description of the invention.

BRIEF DESCRIPTION OF THE DRAWING

FIGURE is a flow diagram of the process.

DETAILED DESCRIPTION OF THE INVENTION

Oxygen contamination can reduce the quality of many organic streams. Oxygen or oxygenate contamination in kerosene, and jet-fuel which is derived from kerosene, can have deleterious effects on the specifications. The contamination can come about in numerous ways. One example is by contacts with atmospheric oxygen in an unblanketed storage container or shipping vessel. During the transit time and storage time oxygen is dissolved into the kerosene and jet-fuel. Another example is through mercaptan sweetening in the making of jet fuel. The production of jet fuel from kerosene requires several processing steps such as hydroprocessing or mercaptan sweetening. During the mercaptan sweetening process, oxygen is contacted with the kerosene, and some of the oxygen is residual in the jet fuel after the processing.

In some jet turbine engines on aircraft, the jet fuel is circulated between the fuel tanks and the engines to control the engine temperatures. Using jet fuel as a thermal sink for the engine temperatures heats up the jet fuel. During these normal processes, the jet fuel is heated and residual oxygen and oxygenates that are in the jet fuel can react and polymerize to form gums and deposits in the jet fuel circulation system, and in the jet fuel lines to the engines. These deposits change the heat transfer characteristics of the engine, and can affect the flow through the fuel lines resulting in a reduction in the engine performance. In addition, jet fuel and kerosene can be used as a feedstock for the production of normal paraffins in the C10 to C16 range. These normal paraffins are used in the production of linear alkylbenzenes (LAB). LABs are used in the production of biodegradable detergents. During the process of normal paraffin extraction, the kerosene is heated. The heating of the kerosene in the presence of oxygen dissolved in the kerosene can cause polymerization reactions that in turn can result in gums and deposit formation. These gums and deposits result in the fouling of equipment and in increased down time of the processes, and subsequent loss of production.

The oxygen in kerosene is a precursor to hydroperoxides. The hydroperoxide species react using a free radical mechanism to form polymers. The present invention uses a specific set of conditions to strip oxygen from kerosene, and from jet fuel in a controlled fashion resulting in a kerosene and jet fuel product stream with a reduced tendency to form gums and deposits.

The present invention is a process for stripping oxygen from a hydrocarbon feedstream. The process, as illustrated in the FIGURE, comprises passing a hydrocarbon feedstream 10 through a preheater 20, creating a preheated feedstream 22. The preheated feedstream 22 is passed to an oxygen stripper 30. The oxygen stripper 30 strips the hydrocarbon stream of oxygen to create an overhead stream 32 and an intermediate stripped stream 34. The stripper 30 is operated with a stripping gas 36 passed to the stripper 30 to remove oxygen from the hydrocarbon feedstream. The overhead stream 32 created during the stripping process comprises the stripping gas and oxygen. The intermediate stripped stream 34 is passed through a bottoms heater 40 to remove additional stripping gas and additional oxygen from the intermediate stripped stream 34, thereby creating a liquid bottoms stream 42. The liquid bottoms stream 42 is heated to a higher temperature to drive oxygen from solution. The additional stripping gas removed from the liquid bottoms stream is returned to the oxygen stripper 30.

The process can, optionally, include returning a portion 44 of the bottoms liquid stream to the oxygen stripper 30 to maintain a desired heat level in the bottom of the oxygen stripper 30. The stripping gas 36 used to strip oxygen from the hydrocarbon feedstream is a substantially oxygen free gas stream. Examples of suitable stripping gas streams for this application are fuel gas or a hydrogen stream. Other gases that are possible include nitrogen, steam, and carbon dioxide, or other gases that are substantially oxygen free.

This process is preferred for use with hydrocarbon streams in the kerosene boiling range, or in the jet fuel boiling range. The sources of heat for the preheater 20 and the bottoms heater 40 can be supplied by hot streams available elsewhere in the refining facility, thereby minimizing the energy impact of the stripping process.

The preheater 20 heats the feedstream 10 to a temperature below 220° C. for facilitating the removal of oxygen from the feedstream as it is processed in the stripper 30. Preferably the temperature is below 140° C. The control of the temperature is important for maintaining the hydrocarbon stream below a temperature wherein the polymerization reactions substantially occur. Although stripping is generally favored at higher temperatures, the present invention is aimed at controlling the stripping at a temperature below the fouling temperatures, or below temperature where substantial polymerization can take effect due to the presence of oxygen in the hydrocarbon stream.

The bottom heater 40 heats the intermediate stripped stream 34 to a higher temperature to remove dissolved stripping gas. The intermediate stripped stream 34 is heated to a temperature of at least 140° C. The process can further include the addition of anti-foulants 38 to the intermediate stripped stream 34.

The invention can further include a fractionation unit 50 for separating out a light liquid stream 52. The fractionation unit 50 produces a vapor overhead stream 54, a light liquid stream 52 and a heavy bottoms stream 56. The light liquid stream 52 is a light kerosene stream, comprising C10 and lighter hydrocarbons, that can be used for further processing.

The heavy bottoms stream 56 can be further processed by passing the stream to a rerun column 60. The rerun column 60 separates the heavy bottoms stream 56 into an overhead kerosene cut 62, where the kerosene can be further processed. The rerun column 60 further generates a heavy kerosene stream 64 and a heavy bottoms stream 66. Further processing includes using the heavy kerosene stream 64 for the recovery of normal paraffins in the C10 to C14 range for use in linear alkylbenzenes. The heavy bottoms stream 66 comprises C14 and heavier hydrocarbons.

In one embodiment, the process is for the stripping of oxygen from a kerosene feedstream. The process comprises passing the kerosene through a preheater to heat the kerosene to a temperature of approximately 140° C. The preheated kerosene is passed to an oxygen stripper, where a stripping gas removes the dissolved oxygen form the kerosene. The dissolved oxygen is passed out in the overhead stream with the stripping gas, and the stripped kerosene is passed out of the bottom of the stripper. The kerosene exiting at the bottom of the stripper is heated with a bottoms heater to remove any dissolved stripping gas, and a portion of the heated kerosene may be cycled back to the bottom of the stripper to heat the bottom section of the oxygen stripper.

While the invention has been described with what are presently considered the preferred embodiments, it is to be understood that the invention is not limited to the disclosed embodiments, but it is intended to cover various modifications and equivalent arrangements included within the scope of the appended claims.

The invention claimed is:

1. A process for stripping oxygen from a hydrocarbon feedstream, comprising:

passing the feedstream through a preheater, thereby creating a preheated feedstream;

passing the preheated feedstream to an oxygen stripper, thereby creating an intermediate stripped stream;

passing a stripping gas to the oxygen stripper to remove oxygen from the feedstream, thereby creating an overhead stream comprising oxygen;

heating the intermediate stripped stream with a bottom heater, thereby removing additional stripping gas from the intermediate stripped stream and creating a liquid bottoms stream; and returning the removed stripping gas to the oxygen stripper.

2. The process of claim 1 further comprising returning a portion of the bottoms liquid stream to the oxygen stripper.

3. The process of claim 1 wherein the intermediate stripped stream is heated to a higher temperature to further remove residual oxygen compounds from the liquid stream.

4. The process of claim 1 wherein the hydrocarbon is a kerosene or jet fuel stream.

5. The process of claim 1 further comprising passing the bottoms liquid stream to a fractionation column, thereby creating a vapor overhead stream, a light liquid stream and a heavy bottoms stream.

6. The process of claim 5 wherein the light stream comprises C10 and lighter hydrocarbons.

7. The process of claim 5 further comprising passing the heavy bottoms stream to a rerun column, thereby creating an overhead stream and a rerun bottoms stream.

8. The process of claim 7 wherein the rerun bottoms stream comprises C14 and heavier hydrocarbons.

9. The process of claim 1 wherein the preheater heats the feedstream to a temperature below 220° C.

10. The process of claim 9 wherein the preheater heats the feedstream to a temperature below 140° C.

11. The process of claim 1 wherein the bottom heater heats the intermediate stripped stream to a temperature sufficient to remove dissolved stripping gas.

12. The process of claim 11 wherein the bottom heater heats the intermediate stripped stream to a temperature of at least 140° C.

13. The process of claim 1 further comprising adding an anti-foulant to the bottoms liquid stream upstream of the bottoms heater.

14. The process of claim 1 wherein the stripping gas is a fuel gas containing little or no oxygen.

15. The process of claim 1 wherein the stripping gas is hydrogen containing little or no oxygen.

* * * * *